US011719430B1

(12) United States Patent
Wang

(10) Patent No.: US 11,719,430 B1
(45) Date of Patent: Aug. 8, 2023

(54) QUICK ASSEMBLING STRUCTURE FOR CEILING FAN WITH LAMP

(71) Applicant: AIR COOL INDUSTRIAL CO., LTD., Taichung (TW)

(72) Inventor: Cliff Wang, Taichung (TW)

(73) Assignee: AIR COOL INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 18/047,161

(22) Filed: Oct. 17, 2022

(51) Int. Cl.
*F21V 33/00* (2006.01)

(52) U.S. Cl.
CPC ..... *F21V 33/0096* (2013.01)

(58) Field of Classification Search
CPC .. F04D 25/088; F04D 29/646; F21V 33/0096; F21V 21/03; F21V 3/00; F21V 1/00; F21V 21/02; F21V 17/14; F21V 15/04; F21V 17/164; F21V 17/16; H02G 3/20; H01R 24/68; H01R 13/6278; H01R 13/24; H01R 35/04; F21S 8/043; F21S 8/06

See application file for complete search history.

(56) References Cited

U.S. PATENT DOCUMENTS 6,428,188 B1 * 8/2002 Magno, Jr. ..... F21V 3/02 362/253
2018/0058476 A1 * 3/2018 Jones ..... F04D 25/0693
2019/0131751 A1 * 5/2019 McCurry ..... H02K 5/225

* cited by examiner

*Primary Examiner* — Omar Rojas Cadima
(74) *Attorney, Agent, or Firm* — Sinorica Int'l Patent & Trademark

(57) ABSTRACT

A quick assembling structure for a ceiling fan with a lamp is provided. The quick assembling structure includes a first seat and a second seat. The first seat has positioning members. The second seat has recesses and guide holes corresponding to the respective positioning members. The second seat has a plurality of elastic plates corresponding to the guide holes. When the positioning members are inserted into the recesses and the guide holes, the positioning members are pushed to pass through the elastic plates for the positioning members to be secured in the guide holes so that the first seat is combined with the second seat. In addition, the guide holes each have an accommodating groove to prevent the positioning members from being separated. The quick assembling structure improves the convenience and safety for the assembly of a ceiling fan with a lamp.

8 Claims, 9 Drawing Sheets

QUICK ASSEMBLING STRUCTURE FOR CEILING FAN WITH LAMP

FIELD OF THE INVENTION

The present invention relates to a ceiling fan with a lamp, and more particularly to a quick assembling structure for a ceiling fan with a lamp.

BACKGROUND OF THE INVENTION

Conventional ceiling fans are mostly fixed to the ceiling. In order to save the installation space of a lamp, a ceiling fan is usually combined with a lamp under the ceiling fan. With the setting of the lamp, the ceiling fan has the lighting effect. However, the lamp is integrally connected to the ceiling fan, so that users cannot change the style of the lamp according to different preferences. It is also impossible to change the lighting brightness of the lamp according to different usage requirements, which causes great inconvenience in use.

An improved ceiling fan with a lamp is developed on the market. As shown in FIG. 1, a connecting cap 3 is connected between a fixing member 1 of the ceiling fan and a lamp 2. The connecting cap 3 is provided with an inner groove seat 4. The edge of the inner groove seat 4 extends outward and is provided with a bottom plate 5. The bottom plate 5 is formed with a plurality of locking grooves 6. One end of each locking groove 6 is formed with a positioning hole 7. The screws 8 of the lamp 2 respectively pass through the corresponding positioning holes 7 of the connecting cap 3, and the screws 8 are moved to the corresponding locking grooves 6. Through the screws 8 of the lamp 2 to be positioned in the locking grooves 6, the fixing member 1 of the ceiling fan and the lamp 2 are combined and fixed. However, if the ceiling fan runs and vibrates for a long time, it is easy to cause the screws 8 to loosen or displace. The screws 8 may move from the locking grooves 6 to the positioning holes 7 and even fall off from the positioning holes 7, causing the lamp 2 to fall. It is not safe for use. Accordingly, the inventor of the present invention has devoted himself based on his many years of practical experiences to solve these problems.

SUMMARY OF THE INVENTION

The primary object of the present invention is to provide a quick assembling structure for a ceiling fan with a lamp, which improves the convenience and safety for the assembly of the ceiling fan and the lamp.

In order to achieve the above object, the present invention provides a quick assembling structure, mounted to a ceiling fan. The ceiling fan has a ceiling fan body and a lamp under the ceiling fan body. The quick assembling structure comprises a first seat, a second seat, and a plurality of elastic plates. The first seat is disposed on one of the ceiling fan body and the lamp. The first seat has a first peripheral wall. The first peripheral wall has a plurality of positioning members extending transversely. The positioning members are arranged at intervals. The second seat is disposed on the other one of the ceiling fan body and the lamp. The second seat has a second peripheral wall to be connected to the first peripheral wall. The second seat has an opening on a receiving side of the second peripheral wall. The second peripheral wall has recesses that are recessed transversely and correspond to the respective positioning members. The recesses each extend longitudinally. The recesses each have one side communicating with the opening for positioning and receiving the positioning members. The recesses each have another side provided with a guide hole. The guide hole extends and tapers toward a tightening end along a guide direction via a guide path. The guide holes of the recesses are configured to guide the respective positioning members. The tightening ends of the guide holes of the recesses are configured to secure the respective positioning members. One side of the guide hole, adjacent to the opening, is recessed to form an accommodating groove. The accommodating groove extends from the guide hole toward the opening. The accommodating groove is configured to accommodate a corresponding one of the positioning members. The elastic plates are disposed on the second seat. The elastic plates each correspond to the guide path of the guide hole. The elastic plates each have a fixed end and an open end. The fixed end is fixedly connected to the second seat. The open end has two push portions and a contact portion. In a normal state, the open end of each elastic plate is in the guide path of the corresponding guide hole, and the open end of each elastic plate is located between the accommodating groove of the corresponding guide hole and the tightening end. The push portions of the open end of each elastic plate extend toward the accommodating groove of the corresponding guide hole and the tightening end for the corresponding positioning member to push against the push portions. In the normal state, the contact portion of the open end of each elastic plate is in contact with the second seat. When the elastic plates are in a stressed state, the push portions and the contact portion of the open end of each elastic plate are away from the guide path.

In the quick assembling structure provided by the present invention, when the positioning members are inserted into the recesses and the guide holes, the positioning members are pushed to pass through the push portions of the elastic plates for the positioning members to be secured at the tightening ends of the guide holes of the recesses, so that the first seat is combined with the second seat to quickly complete assembly of the ceiling fan and the lamp. When the positioning members leave the tightening ends of the guide holes and the push portions of the elastic plates, the accommodating grooves of the guide holes are configured to prevent the positioning members from leaving the guide holes, thereby preventing the lamp from falling. After the positioning members are pushed against the elastic plates, the contact portions of the elastic plates touch the second seat through its elastic force for a user to confirm the position of the positioning members through a touch feeling or a touch sound.

DETAILED DESCRIPTION OF THE PREFERRED EMBODIMENTS

Figure 1:
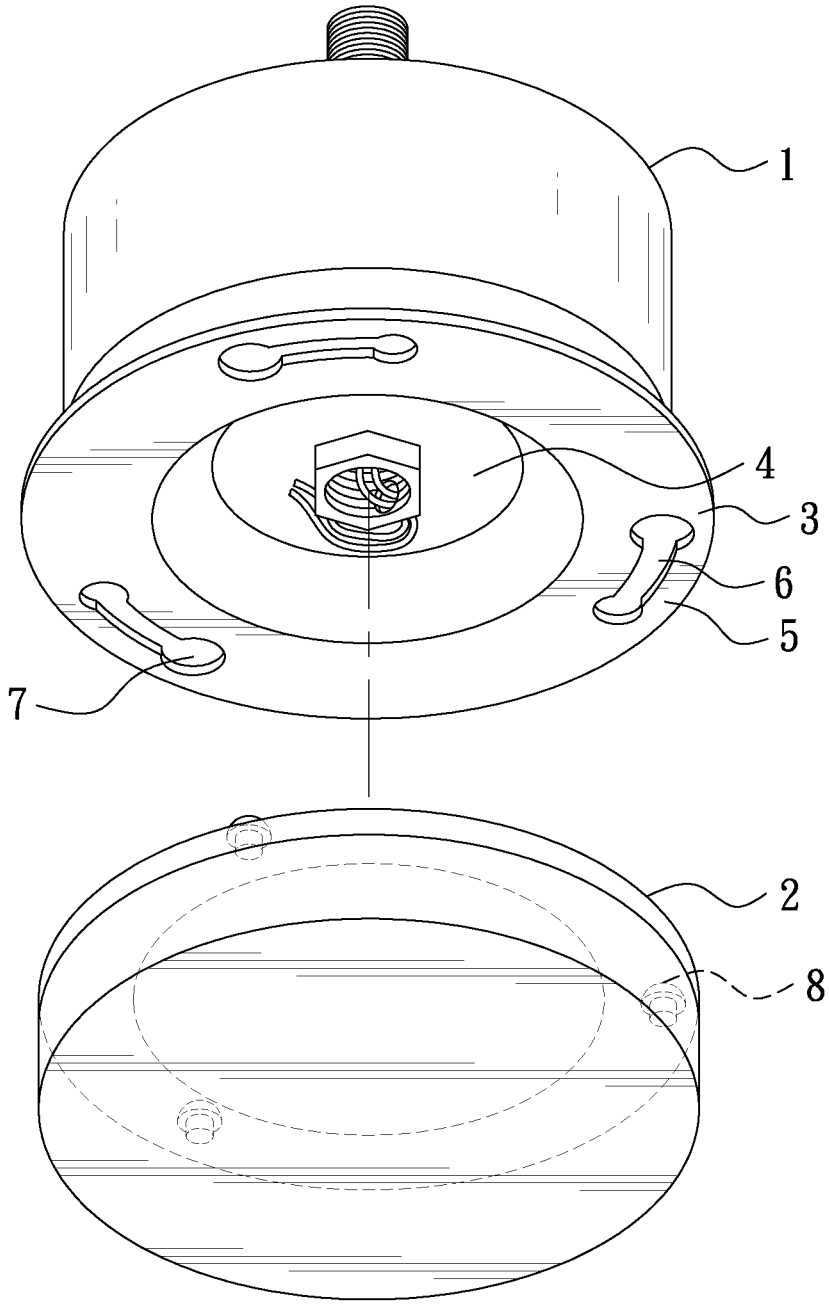
FIG. 1 PRIOR ART
FIG. 1 is an exploded view of a conventional ceiling fan with a lamp.
Figure 2:
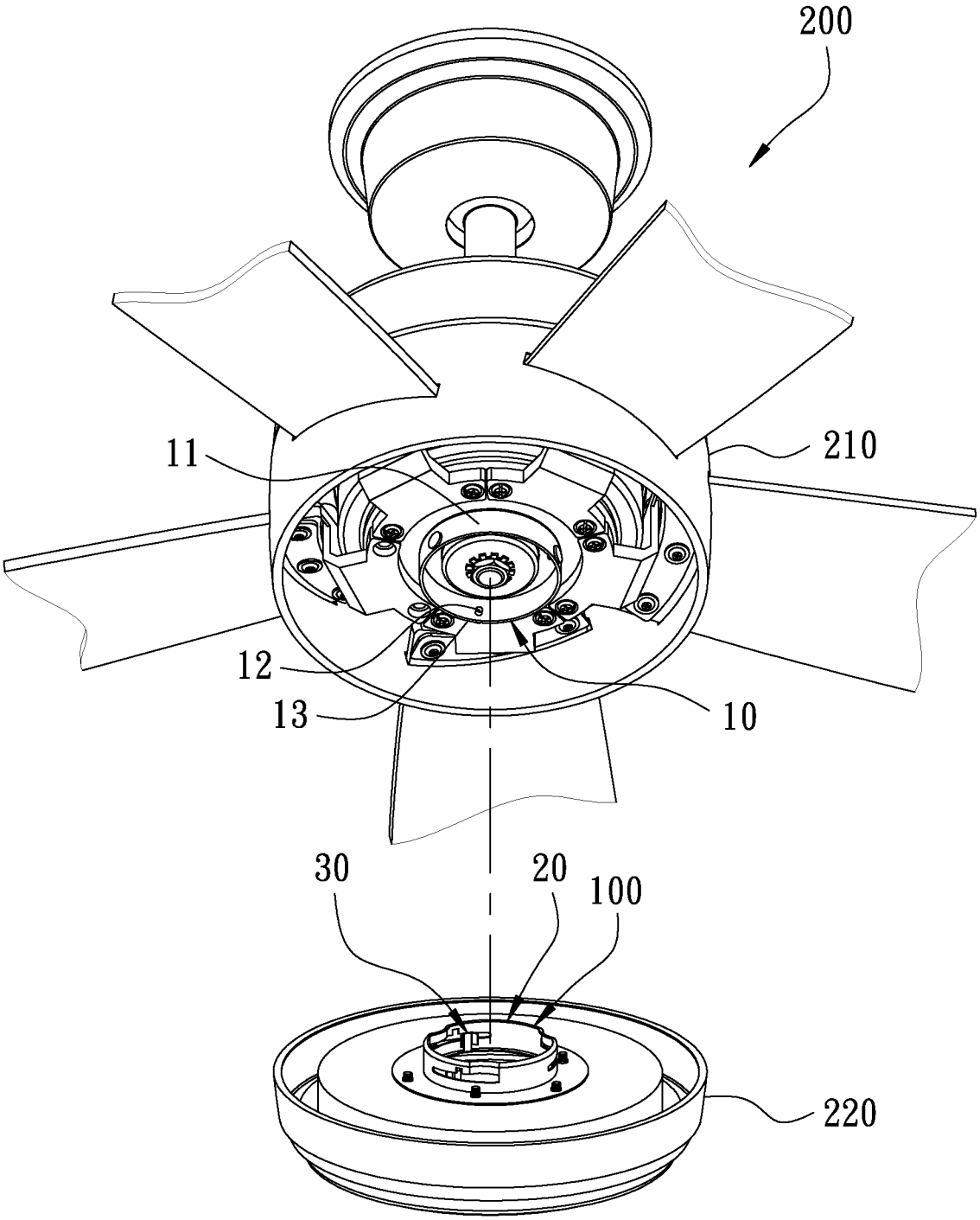
FIG. 2 is an exploded view in accordance with a first embodiment of the present invention.
Figure 3:
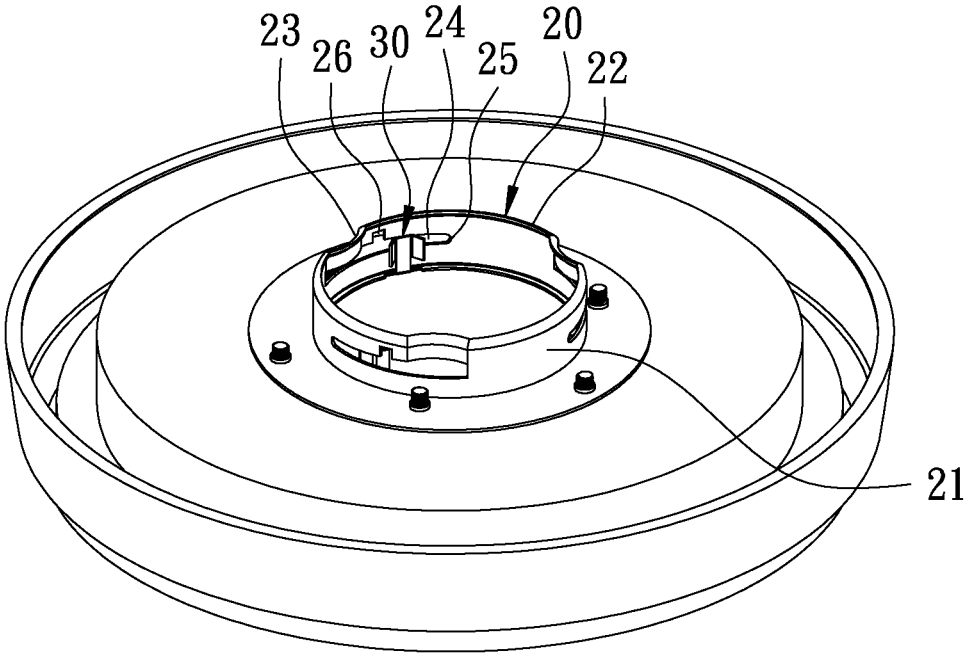
FIG. 3 is a partial perspective view in accordance with the first embodiment of the present invention, illustrating the second seat.
Figure 4:
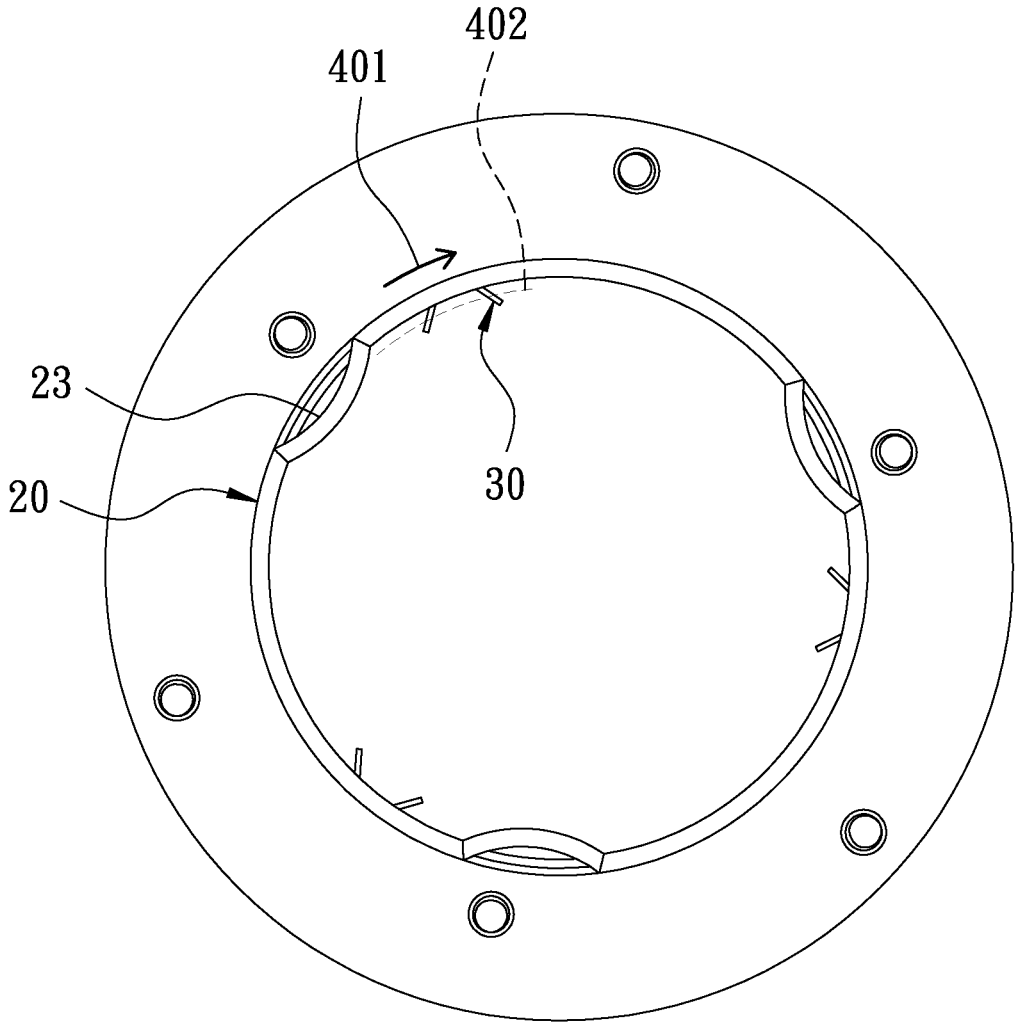
FIG. 4 is a partial top view in accordance with the first embodiment of the present invention, illustrating the second seat.
Figure 5:
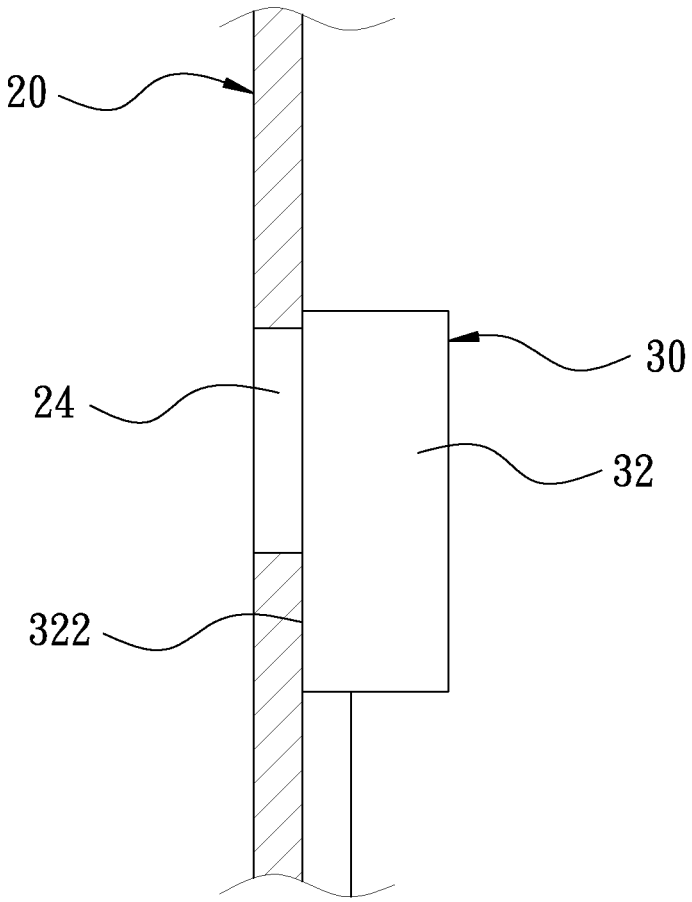
FIG. 5 is a partial cross-sectional view in accordance with the first embodiment of the present invention, illustrating the guide hole, the elastic plate and the second seat.

Embodiments of the present invention will now be described, by way of example only, with reference to the accompanying drawings.

FIGS. 2-6 illustrate a first embodiment of the present invention. The present invention discloses a quick assembling structure 100 for a ceiling fan with a lamp. The quick assembling structure 100 is mounted to a ceiling fan 200. The ceiling fan 200 has a ceiling fan body 210 and a lamp 220 under the ceiling fan body 210. The quick assembling structure 100 comprises a first seat 10, a second seat 20, and a plurality of elastic plates 30.

The first seat 10 is disposed on one of the ceiling fan body 210 and the lamp 220. The first seat 10 has a first peripheral wall 11. In the first embodiment of the present invention, the first seat 10 is disposed on the ceiling fan body 210. The first seat 10 is a hollow seat. The first peripheral wall 11 is an annular wall. The first peripheral wall 11 has a plurality of positioning members 12 extending transversely. The positioning members 12 extend inwardly from the inner side of the first peripheral wall 11. The positioning members 12 are arranged at intervals and equidistant from each other. The positioning members 12 are located on the same plane. The first seat 10 has a receiving opening 13 on a receiving side of the first peripheral wall 11.

The second seat 20 is disposed on the other one of the ceiling fan body 210 and the lamp 220. The second seat 20 has a second peripheral wall 21 to be connected to the first peripheral wall 11. In the first embodiment of the present invention, the second seat 20 is disposed on the lamp 220. When the second peripheral wall 21 is connected to the first peripheral wall 11, the second peripheral wall 21 is located inside the first peripheral wall 11. The second seat 20 is a hollow seat. The second peripheral wall 21 is an annular wall. The second seat 20 has an opening 22 on a receiving side of the second peripheral wall 21. The second peripheral wall 21 has recesses 23 that are recessed transversely and correspond to the respective positioning members 12. The recesses 23 are recessed inwardly from the outer side of the second peripheral wall 21 of the second seat 20. The recesses 23 each extend longitudinally. The recesses 23 each have one side communicating with the opening 22 for positioning and receiving the positioning members 12. The recesses 23 each have another side provided with a guide hole 24. The guide hole 24 extends and tapers toward a tightening end 25 along a guide direction 401 via a guide path 402. The guide direction 401 is a circumferential direction of the second seat 20. The tightening end 25 of the guide hole 24 corresponds in size to the positioning member 12, so that the guide hole 24 can guide the positioning member 12. The tightening end 25 of the guide hole 24 is configured to secure the positioning member 12. In addition, one side of the guide hole 24, adjacent to the opening 22, is recessed to form an accommodating groove 26 corresponding to the positioning member 12. The accommodating groove 26 extends from the guide hole 24 toward the opening 22. The accommodating groove 26 is configured to accommodate the positioning member 12.

The elastic plate 30 is disposed on the second seat 20 and corresponds to the guide path 402 of the guide hole 24. The elastic plate 30 has a fixed end 31 and an open end 32. The fixed end 31 of the elastic plate 30 is fixedly connected to the second seat 20. The open end 32 of the elastic plate 30 has two push portions 321 and a contact portion 322. In the normal state, the open end 32 of the elastic plate 30 is in the guide path 402 of the corresponding guide hole 24, and the open end 32 of the elastic plate 30 is located between the accommodating groove 26 of the corresponding guide hole 24 and the tightening end 25. The push portions 321 of the open end 32 of the elastic plate 30 extend toward the accommodating groove 26 of the corresponding guide hole 24 and the tightening end 25 for the corresponding positioning member 12 to push against the push portions 321. In the normal state, the contact portion 322 of the open end 32 of the elastic plate 30 is in contact with the second seat 20. When the elastic plate 30 is in a stressed state, the push portions 321 and the contact portion 322 of the open end 32 of the elastic plate 30 are away from the guide path 402.

Figure 6:
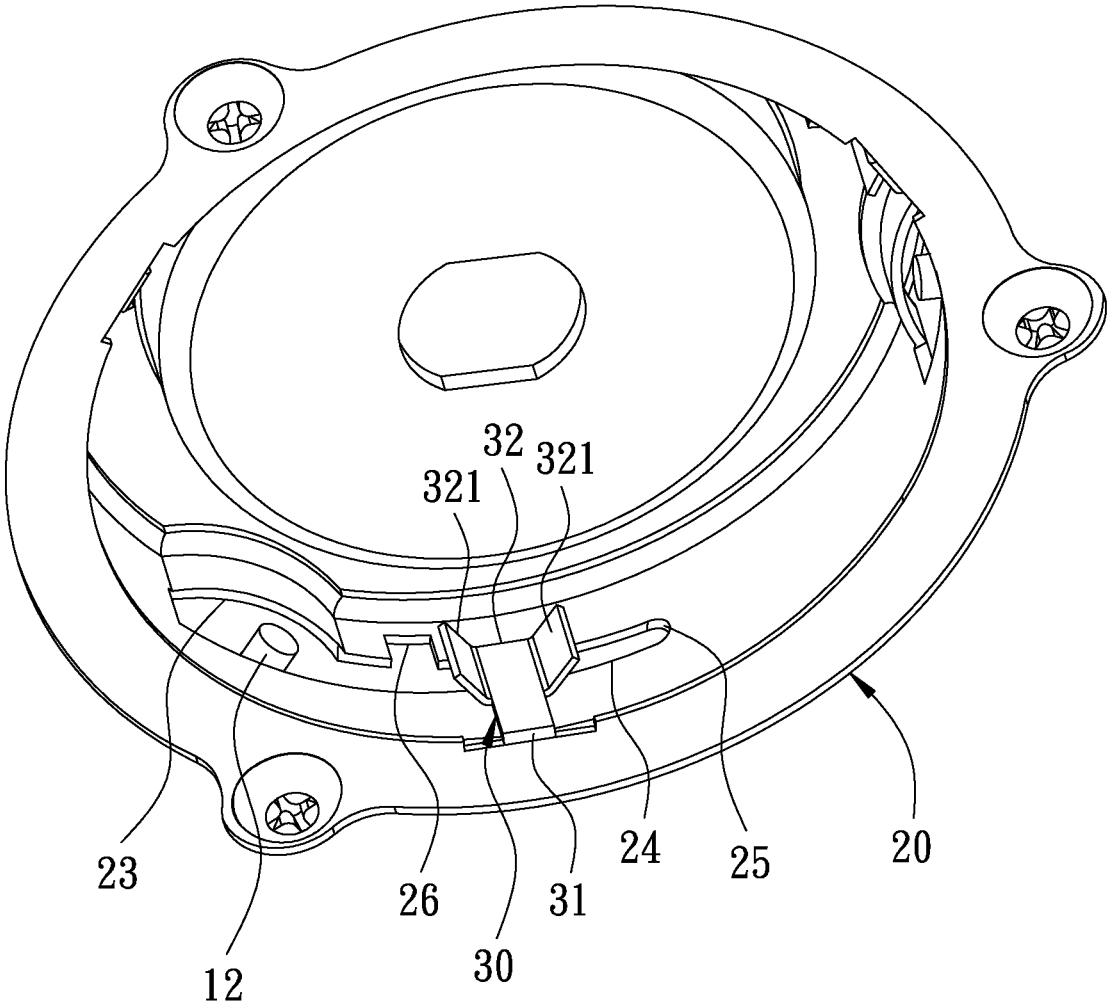
FIG. 6 is a schematic view in accordance with the first embodiment of the present invention when in use, illustrating the positioning member inserted into the recess.
Figure 7:
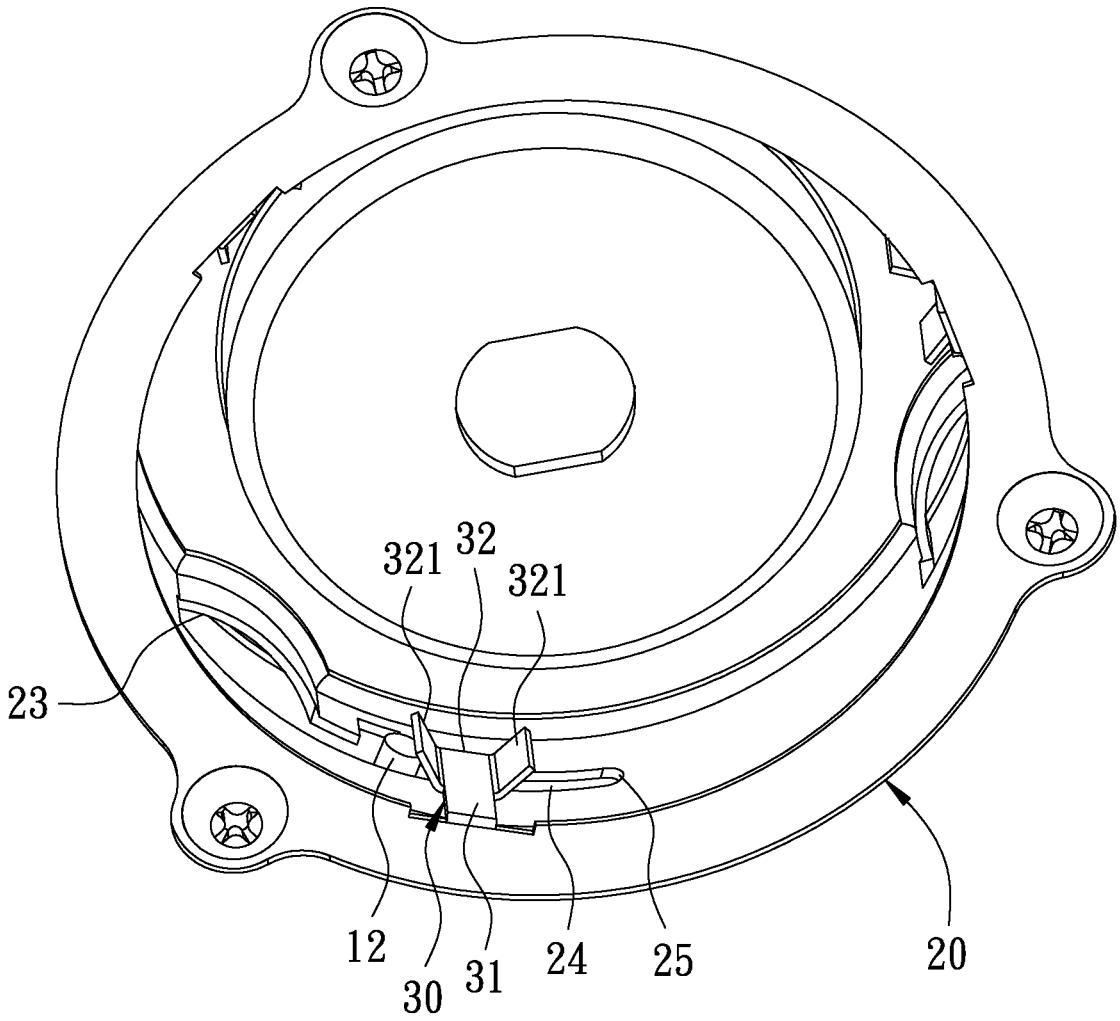
FIG. 7 is a schematic view in accordance with the first embodiment of the present invention when in use, illustrating the positioning member pushed against the elastic plate.
Figure 8:
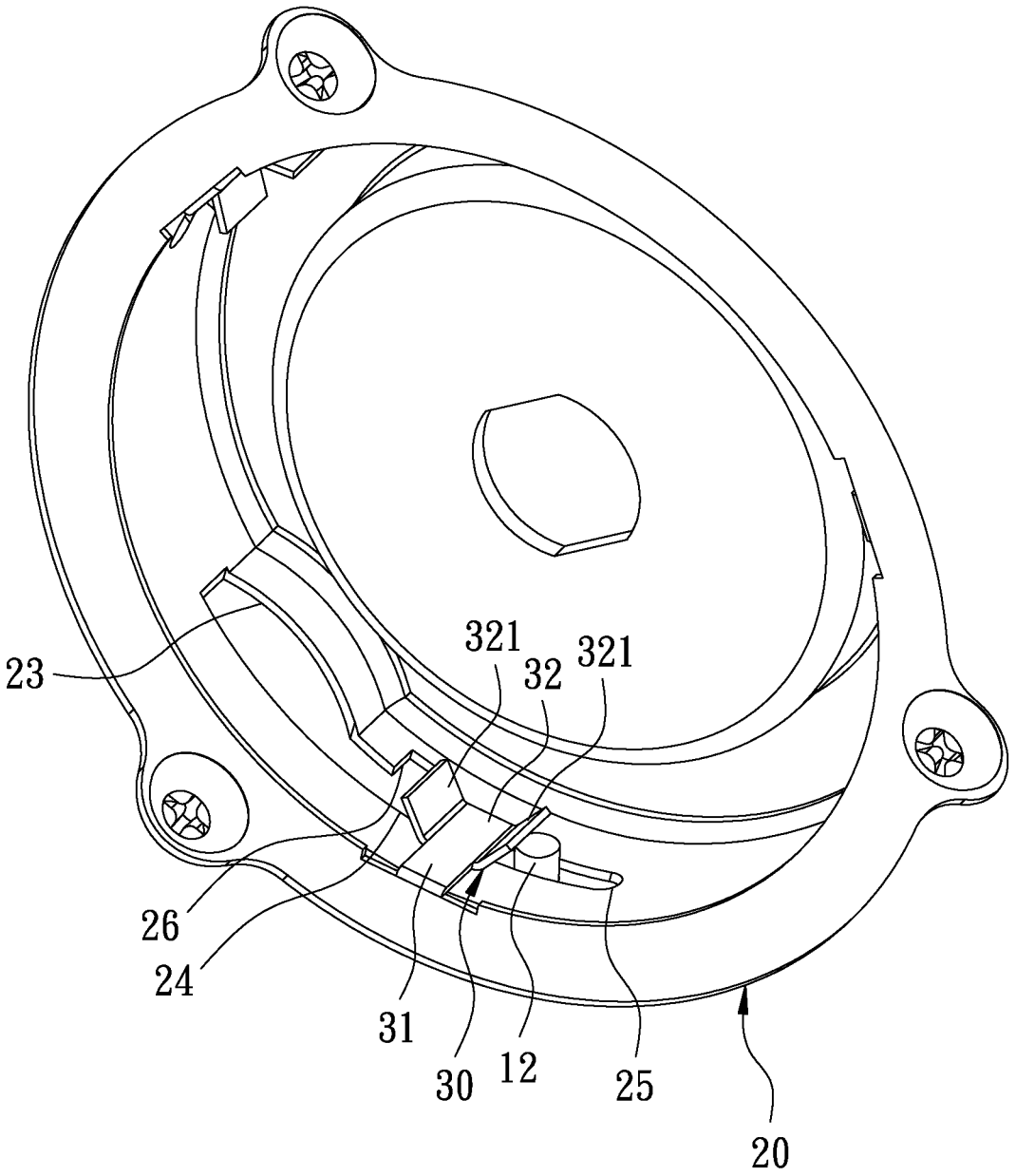
FIG. 8 is a schematic view in accordance with the first embodiment of the present invention when in use, illustrating the positioning member secured at the tightening end of the guide hole.

Referring to FIGS. 6-8, when the quick assembling structure 100 is to be assembled, the first peripheral wall 11 of the first seat 10 is fitted to the second peripheral wall 21 of the second seat 20, and the positioning members 12 of the first peripheral wall 11 are inserted into the corresponding recesses 23 and the guide holes 24, respectively. At this time, each positioning member 12 of the first peripheral wall 11 is moved toward the tightening end 25 of the guide hole 24 along the guide direction 401 via the guide path 402. The positioning member 12 is pushed to pass through the push portions 321 of the elastic plate 30, and then the positioning member 12 is secured at the tightening end 25. The first peripheral wall 11 of the first seat 10 and the second peripheral wall 21 of the second seat 20 are rotatably engaged with each other, so that the ceiling fan body 210 and the lamp 220 are combined with each other to quickly complete the assembly of the ceiling fan 200.

When the quick assembling structure 100 is to be disassembled or replaced, the second seat 20 with the lamp 220 is rotated in an opposite direction. The positioning member 12 is moved toward the corresponding recess 23 via the guide path 402 in a direction opposite to the guide direction 401, so that the positioning member 12 is pushed to pass through the push portions 321 of the elastic plate 30 to be out of the guide hole 24 and the recess 23. That is, the second seat 20 is separated from the first seat 10, so that the lamp 220 is separated from the ceiling fan body 210. In this way, the lamp 220 can be easily replaced.

It is worth mentioning that if the ceiling fan 200 runs and vibrates for a long time, it is easy to cause the positioning members 12 to loosen or displace, resulting in that the positioning members 12 are moved from the tightening ends 25 of the guide holes 24 towards the recesses 25. At this time, the positioning members 12 can be accommodated in the accommodating grooves 26 in the guide holes 24 to prevent the positioning members 12 from moving to the recesses 23. This prevents the second seat 20 from being separated from the first seat 10 to cause the lamp 220 to fall. The present invention improves the safety of assembly effectively.

After the positioning member 12 is pushed against the corresponding elastic plate 30, the push portions 321 and the contact portion 322 of the open end 32 of the elastic plate 30 are away from the guide path 402. Then, the contact portion 322 of the elastic plate 30 touches the second seat 20 through its elastic force for the user to confirm the position of the positioning member 12 through a touch feeling or a touch sound.

Figure 9:
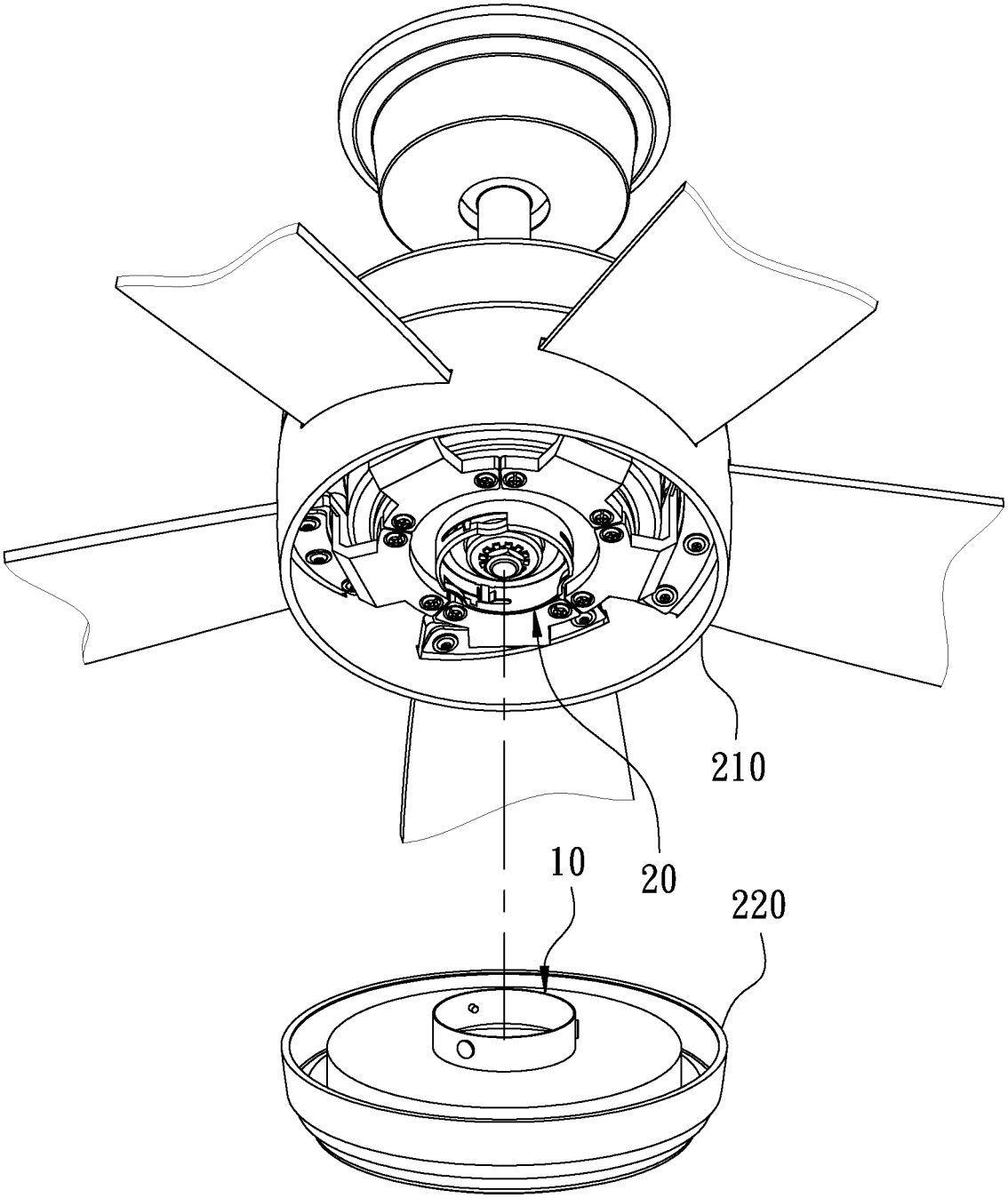
FIG. 9 is an exploded view in accordance with a second embodiment of the present invention.

FIG. 9 is an exploded view in accordance with a second embodiment of the present invention. The second embodiment of the present invention is different from the first embodiment in that the first seat 10 is disposed on the lamp 220, and the second seat 20 is disposed on the ceiling fan body 210. The specific implementation and effect of the second embodiment are the same as the first embodiment of the present invention.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A quick assembling structure, mounted to a ceiling fan, the ceiling fan having a ceiling fan body and a lamp under the ceiling fan body, the quick assembling structure comprising:

a first seat, disposed on one of the ceiling fan body and the lamp, the first seat having a first peripheral wall, the first peripheral wall having a plurality of positioning members extending transversely, the positioning members being arranged at intervals;

a second seat, disposed on the other one of the ceiling fan body and the lamp, the second seat having a second peripheral wall to be connected to the first peripheral wall, the second seat having an opening on a receiving side of the second peripheral wall, the second peripheral wall having recesses that are recessed transversely and correspond to the respective positioning members, the recesses each extending longitudinally, the recesses each having one side communicating with the opening for positioning and receiving the positioning members, the recesses each having another side provided with a guide hole, the guide hole extending and tapering toward a tightening end along a guide direction via a guide path, the guide holes of the recesses being configured to guide the respective positioning members, the tightening ends of the guide holes of the recesses being configured to secure the respective positioning members, one side of the guide hole, adjacent to the opening, being recessed to form an accommodating groove, the accommodating groove extending from the guide hole toward the opening, the accommodating groove being configured to accommodate a corresponding one of the positioning members;

a plurality of elastic plates, disposed on the second seat, the elastic plates each corresponding to the guide path of the guide hole, the elastic plates each having a fixed end and an open end, the fixed end being fixedly connected to the second seat, the open end having two push portions and a contact portion, in a normal state, the open end of each elastic plate being in the guide path of the corresponding guide hole, the open end of each elastic plate being located between the accommodating groove of the corresponding guide hole and the tightening end, the push portions of the open end of each elastic plate extending toward the accommodating groove of the corresponding guide hole and the tightening end for the corresponding positioning member to push against the push portions, in the normal state, the contact portion of the open end of each elastic plate being in contact with the second seat, the push portions and the contact portion of the open end of each elastic plate being away from the guide path when the elastic plates are in a stressed state;

wherein when the positioning members are inserted into the recesses and the guide holes, the positioning members are pushed to pass through the push portions of the elastic plates for the positioning members to be secured at the tightening ends of the guide holes of the recesses so that the first seat is combined with the second seat to quickly complete assembly of the ceiling fan and the lamp; when the positioning members leave the tightening ends of the guide holes and the push portions of the elastic plates, the accommodating grooves of the guide holes are configured to prevent the positioning members from leaving the guide holes, thereby preventing the lamp from falling; after the positioning members are pushed against the elastic plates, the contact portions of the elastic plates touch the second seat through its elastic force for a user to confirm the position of the positioning members through a touch feeling or a touch sound.

2. The quick assembling structure as claimed in claim 1, wherein the first seat is a hollow seat, and the second seat is a hollow seat.

3. The quick assembling structure as claimed in claim 1, wherein the first peripheral wall is an annular wall, and the second peripheral wall is an annular wall.

4. The quick assembling structure as claimed in claim 3, wherein the positioning members extend inwardly from an inner side of the first peripheral wall, the recesses are recessed inwardly from an outer side of the second peripheral wall of the second seat, when the second peripheral wall is connected the first peripheral wall, the second peripheral wall is located inside the first peripheral wall.

5. The quick assembling structure as claimed in claim 1, wherein the tightening ends of the guide holes correspond in size to the positioning members, respectively, the guide direction is a circumferential direction of the second seat.

6. The quick assembling structure as claimed in claim 1, wherein the first seat has a receiving opening on a receiving side of the first peripheral wall.

7. The quick assembling structure as claimed in claim 1, wherein the positioning members are located on a same plane.

8. The quick assembling structure as claimed in claim 1, wherein the positioning members are equidistant from each other.

* * * * *